US007673872B2

(12) United States Patent
Lee et al.

(10) Patent No.: US 7,673,872 B2
(45) Date of Patent: Mar. 9, 2010

(54) SHEET FEEDING UNIT AND IMAGE FORMING APPARATUS HAVING THE SAME

(75) Inventors: Jin Soo Lee, Suwon-si (KR); Jae Yong Kim, Suwon-si (KR); Ki Hun Kim, Yongin-si (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 85 days.

(21) Appl. No.: 11/849,528

(22) Filed: Sep. 4, 2007

(65) Prior Publication Data

US 2008/0093792 A1 Apr. 24, 2008

(30) Foreign Application Priority Data

Oct. 20, 2006 (KR) ..... 10-2006-0102530

(51) Int. Cl.
*B65H 1/10* (2006.01)
*B65H 1/12* (2006.01)

(52) U.S. Cl. ..... 271/160; 271/162; 271/167; 271/169; 271/126; 271/127

(58) Field of Classification Search ..... 271/160, 271/162, 167, 169, 126, 127
See application file for complete search history.

(56) References Cited

U.S. PATENT DOCUMENTS 4,307,878 A * 12/1981 Kono ..... 271/22
5,823,525 A * 10/1998 Miki ..... 271/127
6,039,315 A * 3/2000 Lim ..... 271/160
6,485,015 B2 * 11/2002 Yen et al. ..... 271/121
6,540,221 B2 * 4/2003 Nakashima et al. ..... 271/121
6,575,453 B2 * 6/2003 Chiang ..... 271/124
6,585,254 B2 * 7/2003 Hsieh ..... 271/127
2002/0000691 A1 * 1/2002 Takai ..... 271/113
2002/0036377 A1 * 3/2002 Togashi ..... 271/127
2002/0066992 A1 * 6/2002 Lim et al. ..... 271/117
2004/0051233 A1 * 3/2004 Jeong et al. ..... 271/162
2005/0001372 A1 * 1/2005 Yuza et al. ..... 271/121

(Continued)

FOREIGN PATENT DOCUMENTS

EP 0 753 414 A2 1/1997

(Continued)

OTHER PUBLICATIONS

European Search Report issued Dec. 12, 2008 in Europe Application No. 07116690.4.

*Primary Examiner*—Patrick H Mackey
*Assistant Examiner*—Prasad V Gokhale
(74) *Attorney, Agent, or Firm*—Stanzione & Kim LLP

(57) ABSTRACT

A sheet feeding unit and an image forming apparatus having the same. The image forming apparatus includes a body and the sheet feeding unit to supply sheets into the body. The sheet feeding unit includes a sheet feeding cassette coupled to the body, a sheet lifting plate positioned in the sheet feeding cassette to stack sheets thereon, a pick-up device to feed the sheets piece by piece from the sheet feeding plate, and an adjustment unit to vary a sheet feeding force by which the sheets are fed from the sheet lifting plate. Accordingly, the sheets can be smoothly fed into the body without skewing through adjustment of a sheet feeding force of the pick-up device.

20 Claims, 7 Drawing Sheets

U.S. PATENT DOCUMENTS

| | | | | |
|---|---|---|---|---|
| 2005/0087922 | A1* | 4/2005 | Zhang et al. | 271/160 |
| 2006/0255530 | A1* | 11/2006 | Ma | 271/126 |
| 2007/0001376 | A1* | 1/2007 | Lim et al. | 271/121 |
| 2007/0045937 | A1* | 3/2007 | Lee et al. | 271/126 |
| 2007/0052156 | A1* | 3/2007 | Lee et al. | 271/160 |
| 2007/0063423 | A1* | 3/2007 | Kirby | 271/126 |
| 2007/0170640 | A1* | 7/2007 | Miyazaki | 271/127 |
| 2008/0093792 | A1* | 4/2008 | Lee et al. | 271/126 |

FOREIGN PATENT DOCUMENTS

| | | |
|---|---|---|
| JP | 2001026326 | 1/2001 |
| JP | 2002240966 | 8/2002 |
| JP | 2003002456 | 1/2003 |
| JP | 2004307092 | 11/2004 |
| KR | 2005-39061 | 4/2005 |

* cited by examiner

SHEET FEEDING UNIT AND IMAGE FORMING APPARATUS HAVING THE SAME

CROSS-REFERENCE TO RELATED APPLICATIONS

This application claims the benefit under 35 U.S.A. §119 from Korean Patent Application No. 2006-0102530, filed on Oct. 20, 2006 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to a sheet feeding unit to automatically feed sheets to a print unit in a body of an image forming apparatus, and an image forming apparatus having the same.

2. Description of the Related Art

A conventional image forming apparatus, such as a laser printer, an ink-jet printer, a multi-function printer, a copying machine, etc., generally include a body defining an appearance of the image forming apparatus, a print unit positioned within the body, a sheet feeding unit to automatically feed sheets to the print unit, and a sheet discharge unit to discharge the printed sheets to an outside of the body. The print unit serves to print black and white images or color images on surfaces of the sheets through application of toner or ink to the sheets supplied from the sheet feeding unit, according to a printing method.

The sheet feeding unit includes a sheet stacking device such as a sheet feeding cassette or a sheet feeding tray on which the sheets are stacked, and a pick-up device to separate and feed the sheets piece by piece from the sheet stacking device to the print unit. The pick-up device includes one or more pick-up rollers which are made of rubber material having a high friction coefficient. Among the sheet stacking devices, the sheet feeding cassette is suitable for an automatic sheet feeding unit for automatic printing due to capability of stacking a plurality of sheets having the same dimensions, whereas the sheet feeding tray is suitable for a manual sheet feeding unit due to capability of permitting a single sheet or a small number of sheets to be quickly stacked thereon, if necessary.

Typically, the sheet feeding cassette is detachably inserted into an installation space defined at a lower portion of the body, and has a sheet lifting plate on which the sheets are placed. The sheet lifting plate has one end supported by a spring, and the other end hingably coupled to one side of the sheet feeding cassette. With the above configuration, the sheet lifting plate raises one end of the sheets stacked thereon toward the pick-up device through a pivot behavior of a predetermined angle about a hinge part. The sheet lifting plate is provided at the one end with a sheet separation mechanism to separate the sheets piece by piece. The sheet separation mechanism is provided to the sheet lifting plate to be brought into contact with one end of the sheets stacked on the sheet feeding cassette so that when the pick-up roller pushes the sheets upward, the sheet separation mechanism blocks the one end of the sheets at the one side of the sheet lifting plate, allowing the sheets to be fed piece by piece without overlapping.

Since such a conventional sheet feeding cassette is configured to allow the spring to elastically support the sheet lifting plate with a constant elastic force, the pick-up device applies a constant feeding force. Thus, the conventional sheet feeding unit has a problem in that, when heavy sheets are stacked on the sheet lifting plate, the sheets can be skewed upon pick-up of the sheets due to an insufficient feeding force.

SUMMARY OF THE INVENTION

The present general inventive concept provides a sheet feeding unit which can adjust a sheet feeding force in which a pick-up device applies to sheets, and an image forming apparatus having the same.

The present general inventive concept also provides a sheet feeding unit which can manually adjust the sheet feeding force in which the pick-up device applies to the sheets, and an image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a sheet feeding unit, including a sheet feeding cassette coupled to a body of the image forming apparatus, a sheet lifting plate positioned in the sheet feeding cassette to stack sheets thereon, a pick-up device to feed the sheets piece by piece from the sheet feeding plate, and an adjustment unit to vary a sheet feeding force by which the sheets are fed from the sheet lifting plate.

The adjustment unit may include a lifting device to push the sheet lifting plate toward the pick-up device through application of a variable compressive force to the sheet lifting plate.

The lifting device may include a spring abutted against one side of the sheet lifting plate, and a spring adjustment mechanism to support the spring to adjust an installation height of the spring.

The spring adjustment mechanism may include a guide member positioned at one side of the sheet feeding cassette, and a spring lifting member liftably coupled to the guide member while supporting one end of the spring.

The guide member may have a ring shape open at upper and lower ends, and the spring lifting member may have a cylindrical shape having an outer peripheral surface corresponding to an inner peripheral surface of the guide member and be screwed into the guide member.

The spring lifting member may be exposed to an outside through a bottom surface of the sheet feeding cassette to permit manual adjustment of the spring lifting member.

The inner peripheral surface of the guide member may have a guide key protruding therefrom, and the outer peripheral surface of the spring lifting member may have a spiral groove into which the guide key can be fitted.

The inner peripheral surface of the guide member may have a positioning groove formed therein, and the outer peripheral surface of the spring lifting member may have a positioning protrusion to be fitted into the positioning groove, the positioning protrusion being fitted into the positioning groove as the spring lifting member is rotated.

The foregoing and/or other aspects and utilities of the present general inventive concept may also be achieved by providing and image forming apparatus, including a body, and a sheet feeding unit to supply sheets into the body, the sheet feeding unit including a sheet feeding cassette coupled to the body, a sheet lifting plate positioned in the sheet feeding cassette to stack sheets thereon, a pick-up device to feed the sheets piece by piece from the sheet feeding plate, and an adjustment unit to vary a sheet feeding force by which the sheets are fed from the sheet lifting plate.

The foregoing and/or other aspects and utilities of the present general inventive concept may also be achieved by providing a sheet feeding unit, including a sheet feeding cassette coupled to a body of an image forming apparatus, a sheet lifting plate positioned in the sheet feeding cassette to stack sheets thereon, and a pick-up device having a plurality of pick-up rollers to feed the sheets piece by piece from the sheet feeding plate, the pick-up rollers applying different respective feeding forces when feeding the sheets from the sheet lifting plate.

The sheet feeding unit may further include a sheet separation mechanism positioned at one side of the sheet lifting plate to be brought into contact with one side of the sheets to prevent miss feeding of the sheets, where a pick-up roller near the sheet separation mechanism applies a higher sheet feeding force than any other pick-up rollers.

The sheet feeding unit may further include a plurality of lifting devices positioned in the sheet feeding cassette and corresponding to the respective pick-up rollers to push the sheet lifting plate toward the pick-up device through application of a variable compressive force to the sheet lifting plate.

The foregoing and/or other aspects and utilities of the present general inventive concept may also be achieved by providing an image forming apparatus with an image forming part, the image forming apparatus including a sheet lifting plate to hold at least one sheet of paper, a lifting unit to provide a varying lifting force to the sheet lifting plate corresponding to a weight of the at least one sheet of paper, and a pick-up device to provide a varying pressing force to the sheet lifting plate corresponding to the varying lifting force to feed the at least one sheet of paper to the image forming part.

The image forming apparatus may further include a knob to adjust a height of the lifting unit.

The lifting force of the lifting unit may increase or decrease to correspond with the height thereof.

The lifting unit may further include a spring to provide an elastic force to the sheet lifting plate to lift the sheet lifting plate in a direction towards the pick-up device.

The image forming apparatus may further include a sheet feeding cassette to house the sheet lifting plate, the lifting unit, and the spring.

The sheet lifting plate may be hingeably coupled to a wall of the sheet feeding cassette.

The foregoing and/or other aspects and utilities of the present general inventive concept may also be achieved by providing an image forming apparatus, including a sheet lifting plate to hold recording media, and a pick-up unit to apply a variable friction force to the recording media to pick-up and transfer an uppermost recording medium of the recording media, the variable friction force based on a weight of the recording media on the sheet lifting plate.

The pick-up unit may include a pick-up device to provide a friction force to the recording media, and a lifting unit to provide a variable lifting force to the sheet lifting plate, which causes a variable friction force between the pick-up device and the recording media.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
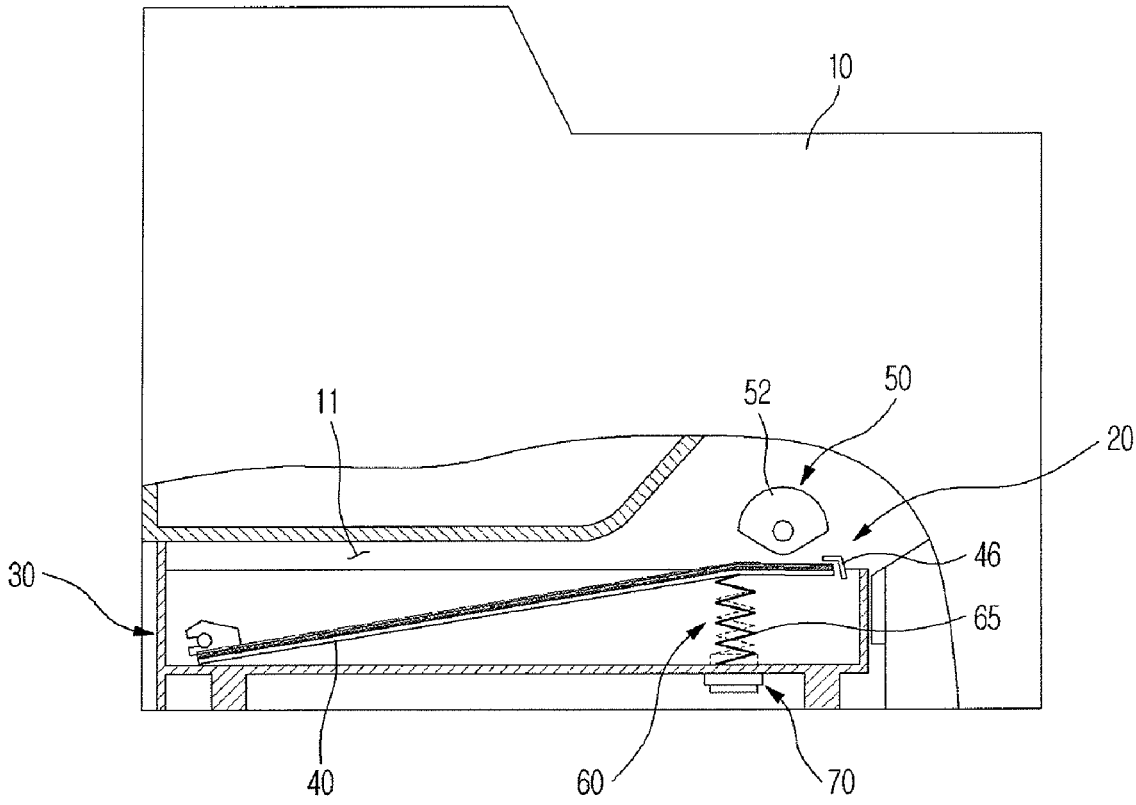
FIG. 1 is a partial side sectional view of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout the drawings. The embodiments are described below to explain the general inventive concept by referring to the figures.

Figure 2:
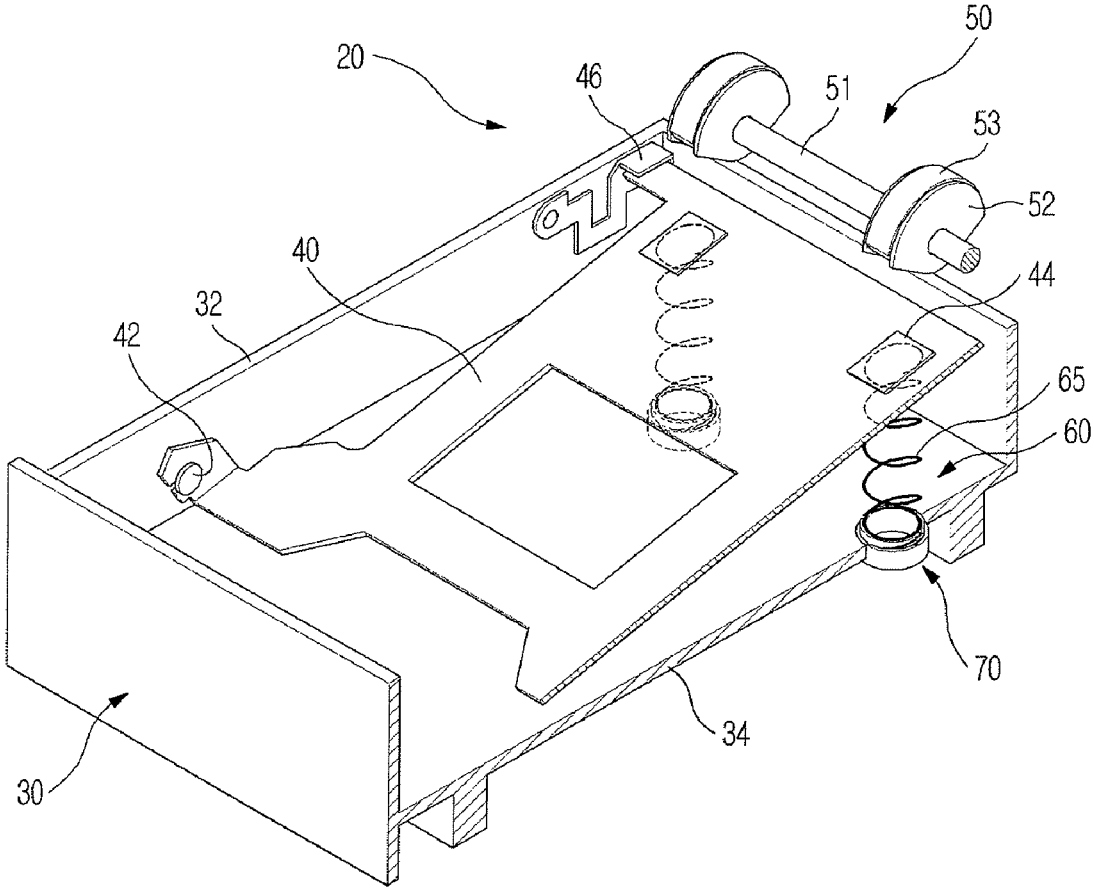
FIG. 2 is a schematic perspective view of a sheet feeding unit of the image forming apparatus of FIG. 1.
Figure 3:
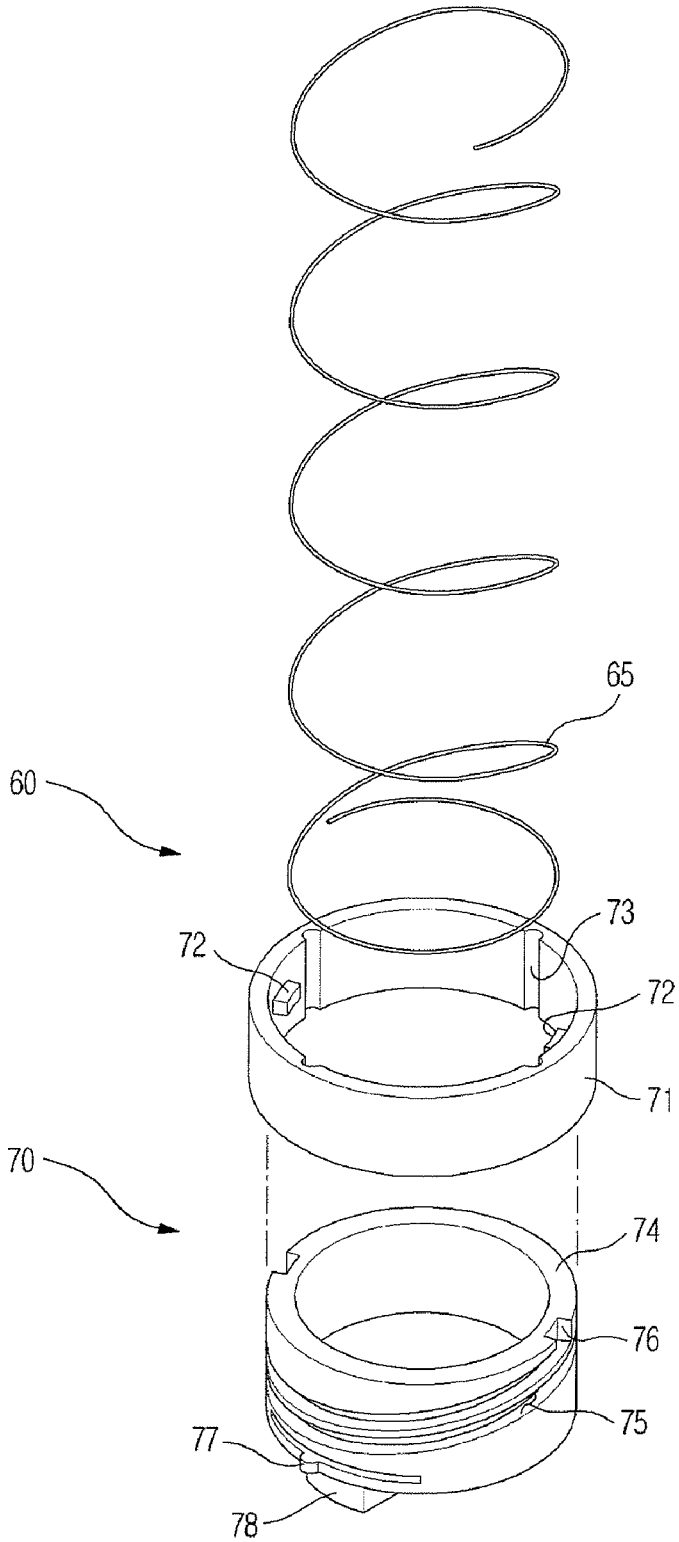
FIG. 3 is an exploded perspective view of a lifting device of the image forming apparatus of FIG. 1.
Figure 4:
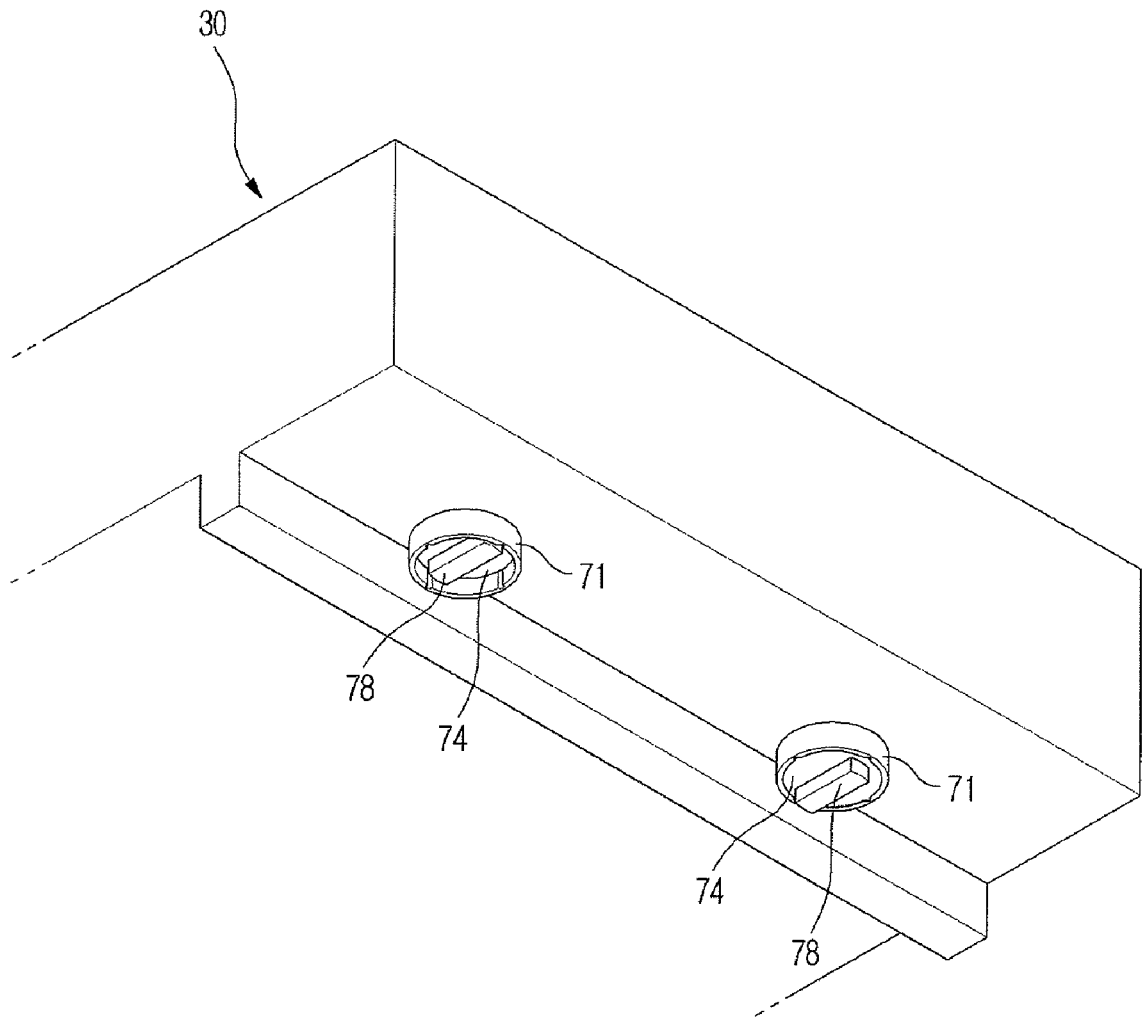
FIG. 4 is a bottom perspective view of a sheet feeding cassette of the image forming apparatus of FIG. 1.
Figure 5:
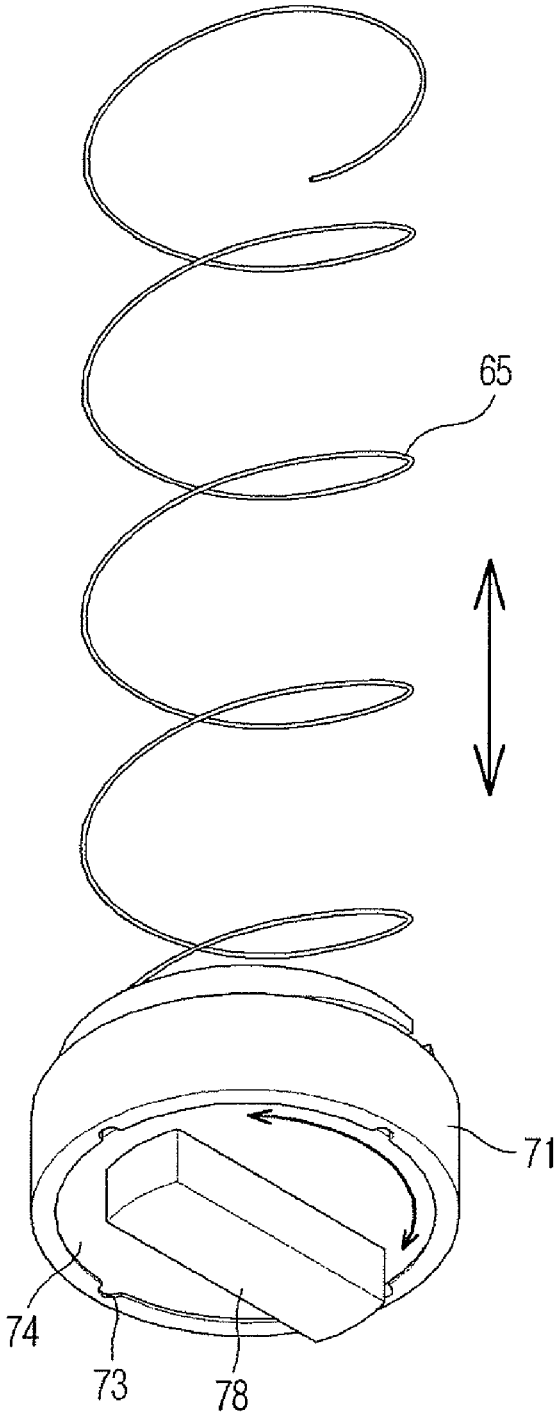
FIGS. 5 and 6 are perspective views illustrating an operation of the lifting device (as illustrated in FIG. 3) of the image forming apparatus of FIG. 1.
Figure 6:
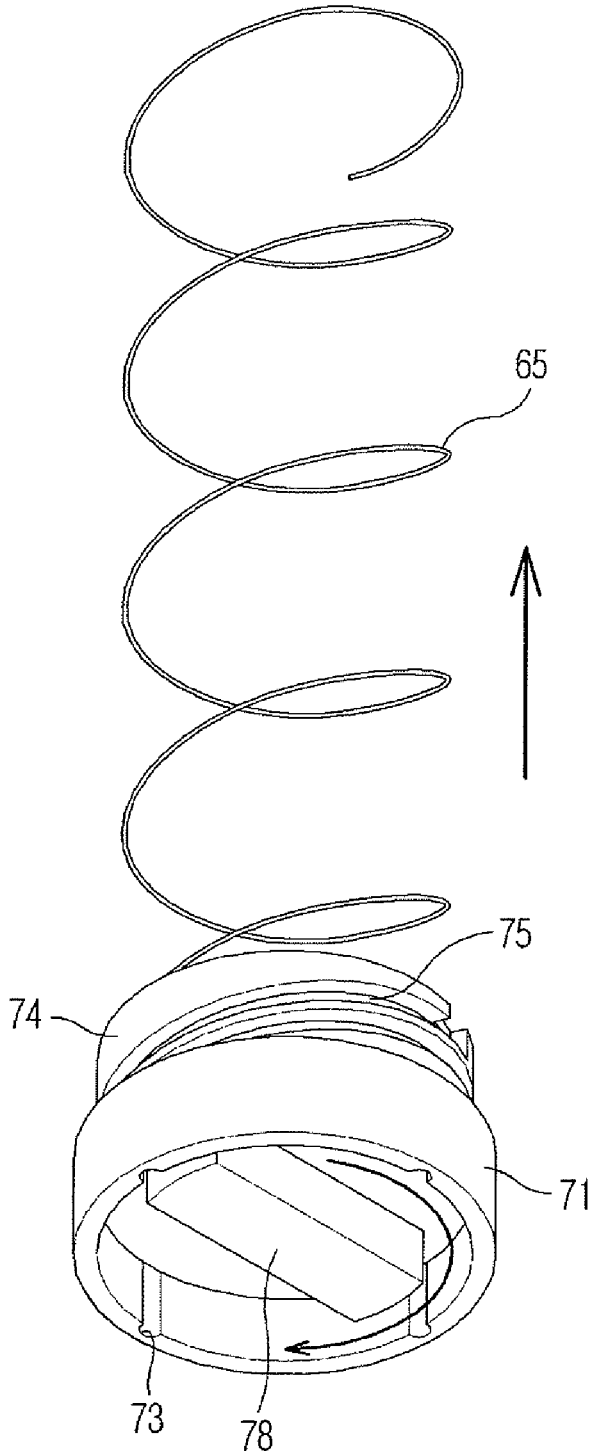
Figure 7:
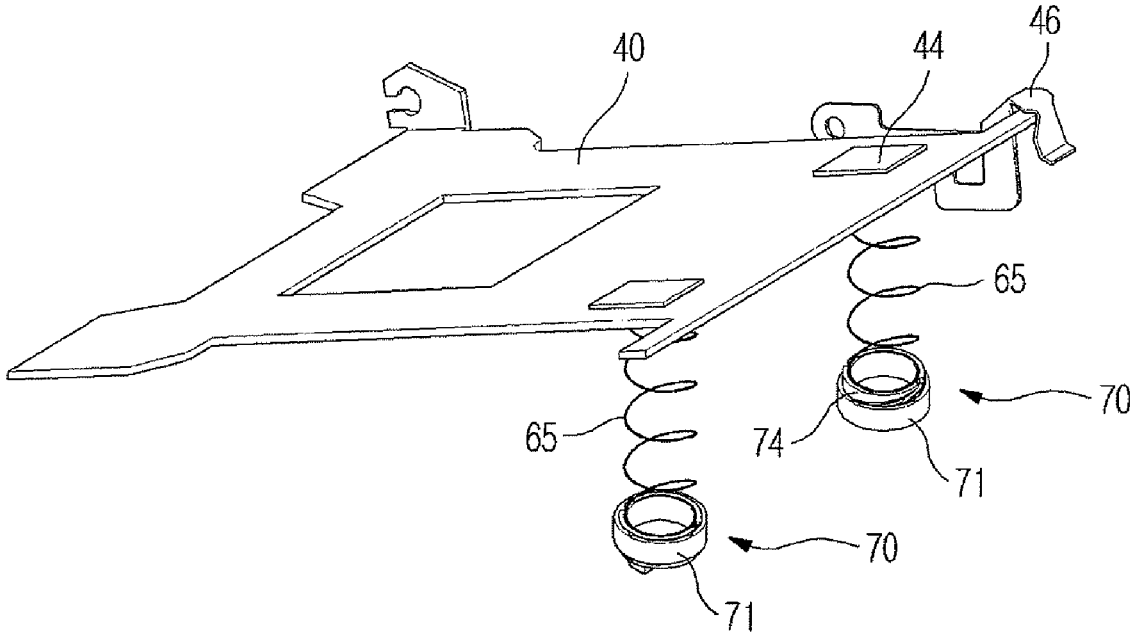
FIG. 7 is a perspective view illustrating an operation of the sheet feeding unit (as illustrated in FIG. 2) of the image forming apparatus of FIG. 1.

FIG. 1 is a partial side sectional view of an image forming apparatus according to an embodiment of the present general inventive concept, FIG. 2 is a schematic perspective view of a sheet feeding unit of the image forming apparatus of FIG. 1, FIG. 3 is an exploded perspective view of a lifting device of the image forming apparatus of FIG. 1, FIG. 4 is a bottom perspective view of a sheet feeding cassette of the image forming apparatus of FIG. 1, FIGS. 5 and 6 are perspective views illustrating an operation of the lifting device (as illustrated in FIG. 3) of the image forming apparatus of FIG. 1, and FIG. 7 is a perspective view illustrating an operation of the sheet feeding unit (as illustrated in FIG. 2) of the image forming apparatus of FIG. 1.

Referring to FIG. 1, the image forming apparatus according to an embodiment of the present general inventive concept includes a body 10 which gives the image forming apparatus a particular shape, and a sheet feeding unit 20 to feed sheets of paper into the body 10.

The body 10 is provided therein with a print unit (not illustrated) to print images on the sheets, a sheet discharge unit (not illustrated) to discharge the printed sheets to an outside, the sheet feeding unit 20, and a generator (not illustrated) to supply a driving force to the print unit, sheet discharge unit, etc. The print unit, sheet discharge unit and generator are similar to those of a conventional image forming apparatus, and thus a detailed description thereof will be omitted herein. The print unit may employ various printing methods such as laser printing, ink-jet printing, etc.

The sheet feeding unit 20 includes a sheet feeding cassette 30 detachably coupled to an installation space 11 and defined at a lower portion of the body 10, a sheet lifting plate 40 positioned in the sheet feeding cassette 30 to stack sheets thereon, a pick-up device 50 to feed the sheets piece by piece from the sheet feeding plate 40, and a pair of lifting devices 60 to push the sheet lifting plate 40 toward the pick-up device 50.

Referring to FIG. 2, the sheet lifting plate 40 has a first end supported by the pair of lifting devices 60, which is positioned in the sheet feeding cassette 30 to lift an end of the sheets stacked on the sheet lifting plate 40 toward the pick-up device 50, and a second end hingedly coupled to a wall 32 of the sheet feeding cassette 30 by a hinge part 42. While the sheets are fed to the pick-up device 50, the first end of the sheet lifting plate 40 is pressed down by the pick-up device 50 and is simultaneously lifted by the lifting devices 60. Accordingly, the sheet lifting plate 40 is lifted to be closer to the pick-up device 50 after each subsequent sheet is picked-up by the pick-up device 50. In addition, the first end of the sheet lifting plate 40 is lifted at a predetermined angle based on a position of the hinge 42.

The sheet lifting plate 40 is provided at the first end thereof with a pair of sheet separation pads 44 to smoothly separate an uppermost sheet from a plurality of sheets stacked on the sheet lifting plate 40. The first edge of the sheet lifting plate 40 is brought into contact with a sheet separation mechanism 46 formed at one side of the sheet feeding cassette 30. The sheet separation mechanism 46 abuts against an edge of the sheets stacked on the sheet lifting plate 40, and serves to allow the sheets to be fed one at a time without miss-feeding or double-feeding when the pick-up device 50 is operated.

The pick-up device 50 includes a roller shaft 51 connected to a generator in the body 10, and a pair of pick-up rollers 52 coupled to the roller shaft 51. Each of the pick-up rollers 52 has a frictional member 53 attached thereon, and is positioned corresponding to each of the sheet separation pads 44 on the sheet lifting plate 40. The pick-up rollers 52 rotate along with the roller shaft 51, and serve to draw the sheets one at a time from the sheet feeding cassette 30 by pushing the sheets in a sheet-feeding direction. The pick-up rollers 52 are separated by a distance identical to a separation distance between the sheet separation pads 44 of the sheet lifting plate 40 in order to provide uniform compression of the lifting devices 60.

Each of the lifting devices 60 acts as an adjustment unit to push the sheet lifting plate 40 toward the pick-up device 50 while varying a sheet feeding force of the pick-up device 50. The lifting device 60 includes a spring 65 to abut against a lower surface of the sheet lifting plate 40, and a spring adjustment mechanism 70 to adjust an installation height of the spring 65. Each of the springs 65 pushes the first end of the sheet lifting plate 40 toward the pick-up device 50 to force the sheets on the sheet lifting plate 40 to be brought into contact with the pick-up device 50.

Accordingly, pressure generated when the pick-up rollers 52 are brought into contact with the sheets on the sheet lifting plate 40 varies depending on a magnitude of an elastic force of the spring 65, which pushes the sheet lifting plate 40 away from a bottom surface 34. Thus, as the elastic force of the spring 65 applied to the sheet lifting plate 40 increases, the sheet feeding force of the pick-up rollers 52 also increases, whereas, as the elastic force of the spring 65 applied to the sheet lifting plate 40 decreases, the sheet feeding force of the pick-up rollers 52 also decreases. The spring adjustment mechanism 70 adjusts the sheet feeding force of the pick-up device 50 by varying the elastic force of the spring 65 applied to the sheet lifting plate 40 through adjustment of an installation height of the corresponding spring 65.

Referring to FIGS. 2 and 3, the spring adjustment mechanism 70 includes a guide member 71 positioned at a side of the bottom surface 34 of the sheet feeding cassette 30, and a spring lifting member 74 liftably coupled to the guide member 71 to support an end of the spring 65 coupled to the bottom surface 34.

The guide member 71 has a ring shape and is open at upper and lower ends, and extends downward through the bottom surface 34 of the sheet feeding cassette 30. The guide member 71 has a pair of guide keys 72 protruding from an inner peripheral surface of the guide member 71 to face each other at different locations. Furthermore, the guide member 71 has a plurality of elongated positioning grooves 73 vertically formed in an inner peripheral surface of the guide member 71. The positioning grooves 73 secure the spring lifting member 74 at a specific height in combination with a plurality of positioning protrusions 77 of the spring lifting member 74 described below. The guide member 71 may be integral to the bottom surface 34 of the sheet feeding cassette 30, or may be a separate member secured to the bottom surface 23.

The spring lifting member 74 has an outer peripheral surface corresponding to the inner peripheral surface of the guide member 71, and has a cylindrical shape, which is open at an upper end and closed at a lower end. A spiral groove 75 is formed around the outer peripheral surface of the spring lifting member 74, and can be fitted with the guide keys 72 of the guide member 71. When the spring lifting member 74 is fitted into the guide member 71 with the guide keys fitted into the spiral groove 75, the spring lifting member 74 is screwed to the guide member 71. Thus, when the spring lifting member 74 is rotated, the spring lifting member 74 moves up or down along the guide member 71.

A pair of key insertion grooves 76 is formed at an upper portion of the spring lifting member 74 to correspond to the pair of guide keys 72. When the spring lifting member 74 is coupled to the guide member 71, the guide keys 72 are fitted into the spiral groove 75 through the corresponding key insertion grooves 76.

The spring lifting member 74 has at least one positioning protrusion 77 formed at one side of the outer peripheral surface thereof. The positioning protrusion 77 is inserted into a corresponding positioning groove 73 among the plurality of positioning grooves 73 in the guide member 71 when the spring lifting member 74, which is screwed into the guide member 71, is rotated and reaches a specific height. There is a slight gap between the inner peripheral surface of the guide member 71 and the outer peripheral surface of the spring lifting member 74, and the positioning protrusion 77 is able to endure a slight elastic deformation so that the spring lifting member 74 can be rotated in a state of being coupled to the guide member 71. A user may manipulate the spring lifting member 74 via a knob 78 provided at a lower portion of the spring lifting member 74.

With the above configuration, since the lifting device 60 is exposed to an outside through the bottom surface 34 of the sheet feeding cassette 30 as illustrated in FIG. 4, the lifting device 60 can be manually manipulated by a user without dissembling or assembling thereof when drawing the sheet feeding cassette 30 from the body of the image forming apparatus. Referring to FIG. 5, when rotating the knob 78 exposed below the sheet feeding cassette 30 in the clockwise or counterclockwise direction, the spring lifting member 74 is moved up or down along the guide member 71, raising and/or lowering the spring 65 towards and/or away from the pick-up device 50. Thus, the user can vary friction between the pick-up roller 52 and the sheets.

For example, as illustrated in FIG. 6, when the knob 78 is rotated in the clockwise direction, the spring lifting member 74 may be moved up along the guide member 71 so that the spring 65 is raised toward the pick-up device 50. As a result, both the elastic force exerted on the sheet lifting plate 40 and the sheet feeding force of the pick-up device 50 are increased.

Operation of the image forming apparatus according to this embodiment will hereinafter be described with reference to the drawings.

As illustrated in FIG. 1, when the sheet feeding cassette 30 having sheets stacked on the sheet lifting plate 40 is mounted in the installation space 11 of the body 10 of the image forming apparatus, one end of the sheets on the sheet lifting plate 40 is located directly below the pick-up roller 52. Then, as printing is started, the pick-up rollers 52 are rotated and push the uppermost sheet among the sheets stacked thereon away from the sheet lifting plate 40. Accordingly, since friction between the sheets and the pick-up rollers 52 is greater than friction between the sheets themselves, the sheets are pushed away from the sheet lifting plate 40 by the pick-up rollers 52. However, the sheet separation mechanism 46 prevents the sheets from all simultaneously being fed to the print unit. Therefore, the sheet separation mechanism 46 contacts the edge of the sheets to separate the sheets in order to feed the sheets to the print unit one at a time.

If heavy sheets are stacked on the sheet feeding plate 40, the image forming apparatus can malfunction due to skewing of the sheets as well as non-smooth separation and feeding of the sheets due to a weak sheet feeding force of the pick-up rollers 52. Accordingly, the spring lifting member 74 may be raised by rotating the knob 78 of the spring lifting member 74. Rotating the knob 78 inadvertently raises the installation height of the spring 65 so that the elastic force of the spring 65 applied to the sheet lifting plate 40 increases. As a result, the sheet feeding force of the pick-up rollers 52 is increased so that such heavy sheets can be smoothly fed without skewing. When rotating the knob 78, the user can determine a suitable installation height of the spring lifting member 74 via vibration that occurs upon insertion of the positioning protrusion 77 of the spring lifting member 74 into the positioning grooves 73 of the guide member 71.

If the sheet separation mechanism 46 is positioned only at one side of the sheet feeding cassette 30 corresponding to one edge of the sheet lifting plate 40, one edge of the sheets contacting the sheet separation mechanism 46 may be subjected to higher resistance than any other edges of the sheets due to the sheet separation mechanism 46. Accordingly, since it is necessary to increase the sheet feeding force at the sheet separation mechanism 46 to allow the sheet to be smoothly fed without skewing, a corresponding spring lifting member 74 can be raised through manipulation of the spring adjustment mechanism 70 near the sheet separation mechanism 46. Then, the spring 65 closest to the sheet separation mechanism 46 can be raised higher than the other spring 65, which is farther from the sheet separation mechanism 46, thereby increasing the sheet feeding force of the pick-up roller 52 near the sheet separation mechanism 46. As a result, the sheets can be smoothly fed without skewing.

According to another embodiment of the present general inventive concept, a number of the pick-up rollers 52 or the lifting devices 60 may be one or may be three or more, and the sheet separation mechanism 46 may be positioned at either side of the sheet lifting plate 40. In addition, although each of the lifting devices 60 is described herein as the adjustment unit to manually vary the sheet feeding force, the lifting devices may automatically vary the sheet feeding force by use of various driving mechanisms known by those skilled in the art.

As apparent from the above description, a sheet feeding unit according to various embodiments of the present general inventive concept can change a sheet feeding force of a pick-up device by varying an elastic force of a spring applied to a sheet lifting plate on which sheets are stacked. Thus, when a weight of the sheets stacked on the sheet lifting plate increases, the sheet feeding unit enables the sheets to be smoothly fed to a print unit by increasing the sheet feeding force of the pick-up device through an increase in the elastic force of the spring applied to the sheet lifting plate.

In addition, according to an embodiment of the present general inventive concept, a number of lifting devices each having the spring to elastically support the sheet lifting plate is provided corresponding to a number of pick-up rollers such that the spring of each lifting device can be adjusted in installation height, allowing the sheet feeding force of the pick-up rollers to be adjusted to permit smooth feeding of the sheets without skewing.

Furthermore, the sheet feeding unit enables the sheet feeding force of the pick-up device to be easily varied through manual manipulation.

Although few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a body; and a sheet feeding unit to supply sheets into the body, the sheet feeding unit comprising:

a sheet feeding cassette coupled to the body, a sheet lifting plate positioned in the sheet feeding cassette to stack sheets thereon, a sheet separation mechanism positioned at one side of the sheet lifting plate to be brought into contact with one side of the sheets to prevent miss-feeding of the sheets, a pick-up device having a plurality of pick-up rollers to feed the sheets one at a time from the sheet feeding plate, and a plurality of adjustment units to vary a sheet feeding force along the sheet lifting plate by which the sheets are fed, each of the plurality of adjustment units capable of being adjusted separately, wherein a pick-up roller near the sheet separation mechanism applies a greater sheet feeding force than another pick-up roller.

2. The image forming apparatus according to claim 1, wherein the adjustment unit comprises:

a lifting device to push the sheet lifting plate toward the pick-up device through application of a variable compressive force to the sheet lifting plate.

3. The image forming apparatus according to claim 2, wherein the lifting device comprises:

a spring abutted against one side of the sheet lifting plate, and a spring adjustment mechanism to support the spring to adjust an installation height of the spring.

4. The image forming apparatus according to claim 3, wherein the spring adjustment mechanism comprises:

a guide member positioned at one side of the sheet feeding cassette; and a spring lifting member liftably coupled to the guide member while supporting one end of the spring.

5. The image forming apparatus according to claim 4, wherein:

the guide member has a ring shape open at upper and lower ends, and the spring lifting member has a cylindrical shape having an outer peripheral surface corresponding to an inner peripheral surface of the guide member and is screwed into the guide member.

6. The image forming apparatus according to claim 5, wherein the spring lifting member is exposed to an outside through a bottom surface of the sheet feeding cassette to permit manual adjustment of the spring lifting member.

7. The image forming apparatus according to claim 5, wherein:

the inner peripheral surface of the guide member has a guide key protruding therefrom and the outer peripheral surface of the spring lifting member has a spiral groove into which the guide key can be fitted.

8. The image forming apparatus according to claim 5, wherein:

the inner peripheral surface of the guide member has a positioning groove formed therein, and the outer peripheral surface of the spring lifting member has a positioning protrusion to be fitted into the positioning groove, the positioning protrusion being fitted into the positioning groove as the spring lifting member is rotated.

9. A sheet feeding unit, comprising:

a sheet feeding cassette coupled to a body of an image forming apparatus;

a sheet lifting plate positioned in the sheet feeding cassette to stack sheets thereon;

a sheet separation mechanism positioned at one side of the sheet lifting plate to be brought into contact with one side of the sheets to prevent miss-feeding of the sheets; and a pick-up device having a plurality of pick-up rollers to feed the sheets one at a time from the sheet feeding plate, the pick-up rollers to apply different feeding forces with respect to one another when feeding the sheets from the sheet lifting plate, wherein a pick-up roller near the sheet separation mechanism applies a greater sheet feeding force than another pick-up roller.

10. The sheet feeding unit according to claim 9, further comprising:

a plurality of lifting devices positioned in the sheet feeding cassette and corresponding to the respective pick-up rollers to push the sheet lifting plate toward the pick-up device through application of a variable compressive force to the sheet lifting plate.

11. An image forming apparatus with an image forming part, the image forming apparatus comprising:

a sheet lifting plate to hold at least one sheet of paper;

a sheet separation mechanism positioned at one side of the sheet lifting plate to be brought into contact with one side of the at least one sheet of paper;

a plurality of lifting units to provide a varying lifting force to the sheet lifting plate corresponding to a weight of the at least one sheet of paper; and a pick-up device having a plurality of pick-up rollers, each providing a varying pressing force to the sheet lifting plate corresponding to the varying lifting force of a respective one of the lifting units to feed the at least one sheet of paper to the image forming part, wherein a pick-up roller near the sheet separation mechanism applies a greater sheet feeding force than another pick-up roller.

12. The image forming apparatus of claim 11, further comprising:

a knob to adjust a height of the lifting units.

13. The image forming apparatus of claim 12, wherein the lifting force of the lifting units increases or decreases to correspond with the height thereof.

14. The image forming apparatus of claim 12, wherein the lifting units further comprises:

a spring to provide an elastic force to the sheet lifting plate to lift the sheet lifting plate in a direction towards the pick-up device.

15. The image forming apparatus of claim 14, further comprising:

a sheet feeding cassette to house the sheet lifting plate and the lifting units.

16. The image forming apparatus of claim 15, wherein the sheet lifting plate is hingeably coupled to a wall of the sheet feeding cassette.

17. An image forming apparatus, comprising:

a sheet lifting plate to hold recording media, the sheet lifting plate having at least one separation pad;

a sheet separation mechanism positioned at one side of the sheet lifting plate to be brought into contact with one side of the recording media to prevent miss-feeding of the recording media; and a pick-up unit having a plurality of pick-up rollers to apply a variable friction force to the recording media to pick-up and transfer an uppermost recording medium of the recording media, the variable friction force based on a weight of the recording media on the sheet lifting plate, wherein a pick-up roller near the sheet separation mechanism applies a greater sheet feeding force than another pick-up roller.

18. The image forming apparatus of claim 17, further comprising:

a lifting unit to provide a variable lifting force to the sheet lifting plate, which causes a variable friction force between the pick-up unit and the recording media.

19. A sheet feeding unit to supply sheets into an image forming apparatus, the sheet feeding unit comprising:

a sheet feeding cassette coupled to the image forming apparatus;

a sheet lifting plate positioned in the sheet feeding cassette to stack sheets thereon;

a sheet separation mechanism positioned at one side of the sheet lifting plate to be brought into contact with one side of the sheets to prevent miss-feeding of the sheets;

a plurality of pick-up units, each of the pick-up units to vary a sheet feeding force to feed the sheets one at a time from the sheet feeding plate; and at least one adjustment unit to vary a sheet feeding force by which the sheets are fed from the sheet lifting plate, wherein a pick-up unit near the sheet separation mechanism applies a greater sheet feeding force than another pick-up unit.

20. An image forming apparatus, comprising:

a sheet lifting plate to hold image recording media;

a sheet separation mechanism positioned at one side of the sheet lifting plate to be brought into contact with one side of the image recording media to prevent miss-feeding of the image recording media;

a plurality of lifting units to provide a varying lifting force along the sheet lifting plate, each of the plurality of lifting units capable of providing different respective lifting forces; and a pick-up device having a plurality of pick-up rollers to feed the image recording media with respect to the varying lifting force, wherein a pick-up roller near the sheet separation mechanism applies a greater sheet feeding force than another pick-up roller.

* * * * *